US005429028A

United States Patent [19]

Fisher, IV

[11] Patent Number: 5,429,028

[45] Date of Patent: Jul. 4, 1995

[54] TREMOLO AND TUNING ASSEMBLY FOR A STRINGED MUSICAL INSTRUMENT

[76] Inventor: Charles H. Fisher, IV, 410 Main St., Coalport, Pa. 16627

[21] Appl. No.: 26,303

[22] Filed: Mar. 4, 1993

[51] Int. Cl.[6] ..... G10D 3/00

[52] U.S. Cl. ..... 84/313

[58] Field of Search ..... 84/298, 307, 313

[56] References Cited

U.S. PATENT DOCUMENTS 4,724,737 2/1988 Fender ..... 84/313
4,742,750 5/1988 Storey ..... 84/313
4,796,505 1/1989 Takeuchi ..... 84/313

*Primary Examiner*—Howard B. Blankenship

*Assistant Examiner*—Patrick J. Stanzione

*Attorney, Agent, or Firm*—Gipple & Hale; John S. Hale

[57] ABSTRACT

A floating one piece tremolo for a stringed instrument allowing adjustment of the instrument and keeping the instrument in tune comprising a housing, a carriage moveably mounted in the housing by a floating pivot point mechanism held together by the action of the instrument strings and tremolo springs opposing each other. The carriage is spring biased and provided with string holding keys which are provided with a locking screw to keep the string eyelet in place on the string holding keys. A saddle guide assembly is mounted to the housing and is vertically and linearly positioned by means of screw members.

28 Claims, 8 Drawing Sheets

FIG. 1 (PRIOR ART)
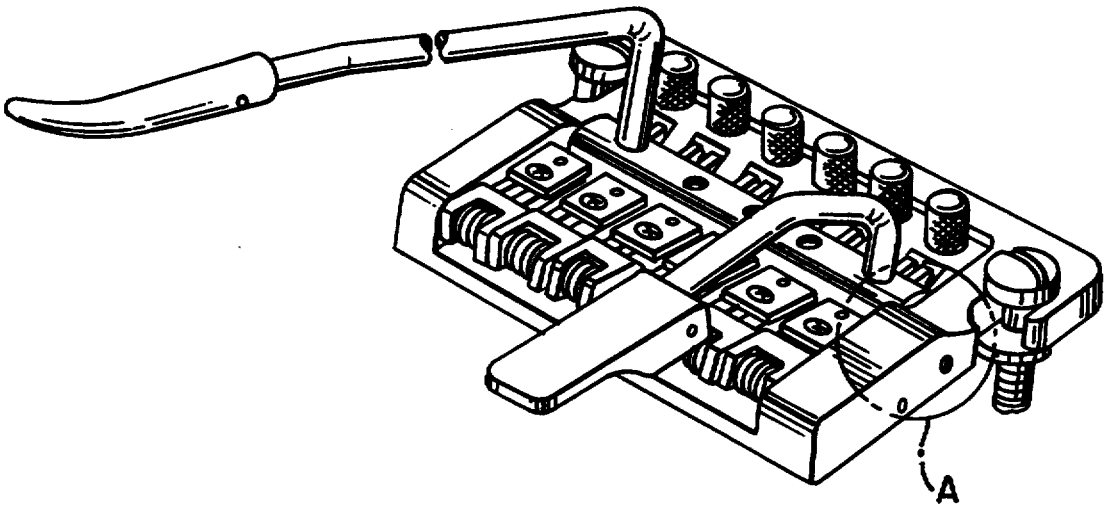
FIG. 2
(PRIOR ART)
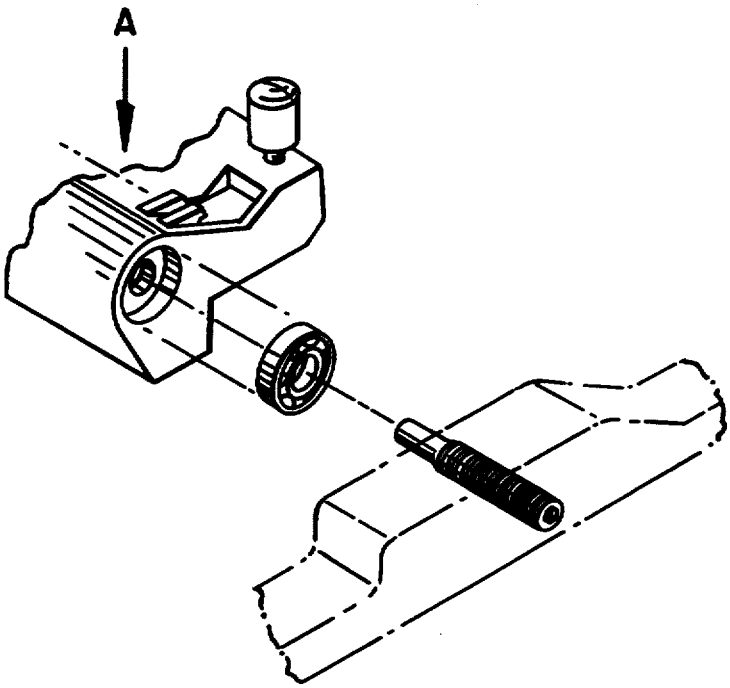
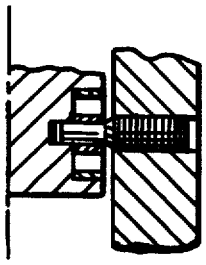
FIG. 3 (PRIOR ART)

TREMOLO AND TUNING ASSEMBLY FOR A STRINGED MUSICAL INSTRUMENT

BACKGROUND OF THE INVENTION

The present invention generally relates to a tremolo for a stringed musical instrument having improved string attachment and tuning. More specifically, the invention is directed to a top mounting self-contained adjustable double point fulcrum tremolo having an easy string mounting and fine tuning assembly and a string guide and intonation adjustment assembly which is mounted in a cavity cut into the stringed musical instrument. The improved tremolo is fully adjustable and yet has a compact configuration for versatile applications to stringed instruments.

BRIEF DESCRIPTION OF THE PRIOR ART

Vibrato devices for stringed musical instruments are well-known in the patented prior art as evidenced by the U.S. patents to: Storey, U.S. Pat. No. 4,457,201; Moseley, U.S. Pat. No. 3,237,502; and Cole U.S. Pat. No. 3,466,962; and by the British Patent Number 905,447 to Underdown.

The Storey '201 patent discloses a combined bridge and tailpiece assembly for a stringed musical instrument with a tailpiece member which is manually rotated to produce a vibrato effect. The tailpiece member is rotatably connected at its ends with the tailpiece block through screws having a smaller diameter portion. The screws are threaded into aligned openings of the tailpiece block with the smaller diameter portion of the screws passing through the central portion of ball bearing races mounted in opposite aligned longitudinal openings in the vertical leg portion to connect the vertical leg portion of the tailpiece member at its ends with the tailpiece block of the assembly. Adjustable string attachment devices in the form of inset blocks, there being one inset block for each of the instrument strings, are each provided with a throughgoing bore to receive a longitudinal rod which passes through aligned openings contained in the base and aligned bores formed in the inset blocks. Each inset block includes a hook portion which receives an instrument string and to which an eyelet portion of the string end is attached. A plurality of adjustable saddle rollers are connected with the tailpiece block and act as a bridge to guide the instrument strings to the string attachment devices. The tailpiece member is spring biased in the other direction of rotation to resist the rotating force exerted on the tailpiece member by the tensioned strings, and at least one lever is connected with the tailpiece member for rotating the same relative to the tailpiece block during sounding of the instrument to produce a vibrato effect.

The Moseley '502 patent discloses a vibrato unit for stringed instruments which includes an adjustable bridge for adjusting the pitch of individual strings. The vibrato unit is mounted on a base for rotation relative thereto to produce a vibrato effect. Similarly, the Cole '962 patent discloses a tremolo device wherein an eccentrically mounted cradle member is rotated relative to a base plate to vary the tone of the sounded strings.

The British '447 patent discloses a vibrato bridge including a base having a platform pivotal thereon. A bridge is arranged on the platform adjacent the pivot and parallel to the axis thereof, and string attachment means are attached to the platform at one side of the bridge and pivot. A lever arm is attached to the platform to pivot the same on the base to change the tension on the strings, thereby to produce a vibrato effect.

While the prior devices normally operate quite satisfactorily, they each possess certain inherent drawbacks which limit their versatility. In order to produce the versatility required from a vibrato device, it is necessary to be able to easily adjust or tune individual strings and to be able to quickly mount and replace new strings in the instrument. The adjustments must be easy to perform by the user of the instrument and the device must not be awkward to use, time consuming or appear bulky on the face of the instrument. The prior devices do not fulfill all these needs. While the Storey '201 patent overcomes many of the aforestated problems, when the tailpiece member is rotated tuning problems occur in that the string pitch changes and string breakage is accelerated. In view of the construction of the Storey device restringing is more difficult and setting intonation is not as easy as in the present invention.

The present invention was developed to provide all of the above features in a combined assembly which is quickly and easily secured to the body of a stringed musical instrument. The assembly has a clean, functional appearance which makes an attractive addition to the instrument while still being completely functional. The assembly includes string adjustment mechanisms which are moveable in respect to each other and are characterized by linear and vertical adjustments to individually position each of the strings of the instrument and a rotatable carrier upon which individual string attachment devices are removably mounted for increased versatility and ease in changing and installing new strings. Furthermore, the vibrato effect produced by the assembly is easily provided owing to the balanced action of the handle member placed in the middle of the carrier, rotating the carrier and increasing or decreasing the tension on the strings while the mounting assembly keeps the instrument in tune.

SUMMARY OF THE INVENTION

Accordingly, it is a primary object of the present invention to provide a carrier and an associated string attachment assembly having a generally "Z" shaped or zig-zag side elevation configuration, the carrier being pivotally mounted to a top mounting housing. The mounting mechanism of the invention is a floating point fulcrum extending from the housing and engaging the carrier. The carrier is connected at its ends with the top mounting housing for rotation about opposed points mounted in respective cones cut in the carrier end wall. Longitudinally spaced string attachment and fine tuning blocks are connected to one end of the carrier allowing easy mounting of the ends of the instrument strings. A plurality of springs connect the carrier and its string attachment assembly to a support block to bias it in the other direction of rotation, to resist the rotating force exerted on it by the tensioned strings. A tremolo lever handle is mounted on the center of the carrier of the string attachment assembly for manually rotating the same relative to the housing during playing of the instrument to produce a vibrato effect and equalize the force on the fulcrum points when in use.

Intonation of the instrument strings occurs after mounting and locking of the instrument strings in the string attachment assembly by moving guide saddles which are moveably mounted to support blocks with respective adjustment screws. The support blocks are in turn fixedly mounted to a rod secured to the top mounting housing. Each guide saddle is provided with an eyelet guide mechanism for containing and guiding the instrument strings.

According to a more specific object of the invention, the string attachment assembly is mounted to the base housing by a point and cone construction.

According to yet another object of the invention, the fine tuning and intonation of each string is individually adjustable.

According to yet another object of the invention, the individual eyelet guide mechanisms in the guide saddles further provide support and guidance of each string.

According to yet another object of the invention, the top mounting tremolo can be mounted in a cavity dimensioned 1 and ¼ inches deep cut in the top of a guitar. Thus, there is no requirement for thru-routing of the guitar or routing for a spring cavity on the back of the guitar and since the unit is self contained it precludes independent spring claw and screws, eliminating the problem of screws pulling out of the wood and springs dislodging.

A further object of the invention is to provide a top mounting self contained fully adjustable double point fulcrum tremolo eliminating all eccentric movement of the unit, reducing friction to an absolute minimum to produce an extremely clean sound. This double point eliminates the need for independent fulcrum posts in the wood or roller bearings which create friction.

In yet another object of the invention is to provide for easy restringing of the instrument and fine tuning of the strings without requiring a special tool and detuning of a string.

According to yet another object of the invention, the mounting of each string is easily accomplished as the cylindrical balls of the string, insert vertically in the string ball cavity instead of horizontally, thereby creating even tension on both sides of the string loop wind resulting in less string-breakage.

In the accompanying drawings, there is shown an illustrative embodiment of the invention from which these and other of objectives, novel features and advantages will be readily apparent.

BRIEF DESCRIPTION OF THE DRAWINGS

FIG. 1 is a perspective view of a prior art tremolo;

FIG. 2 is an enlarged partial exploded perspective view of the mounting assembly of a tailpiece of a prior art tremolo taken from the area shown by circle A in FIG. 1;

FIG. 3 is a cross sectional view of the mounting assembly of the assembled prior art tremolo;

FIG. 6(*b*) is an enlarged rear elevational view of the inventive tremolo removed from an electric guitar;

DETAILED DESCRIPTION OF THE EMBODIMENT

Figure 5:
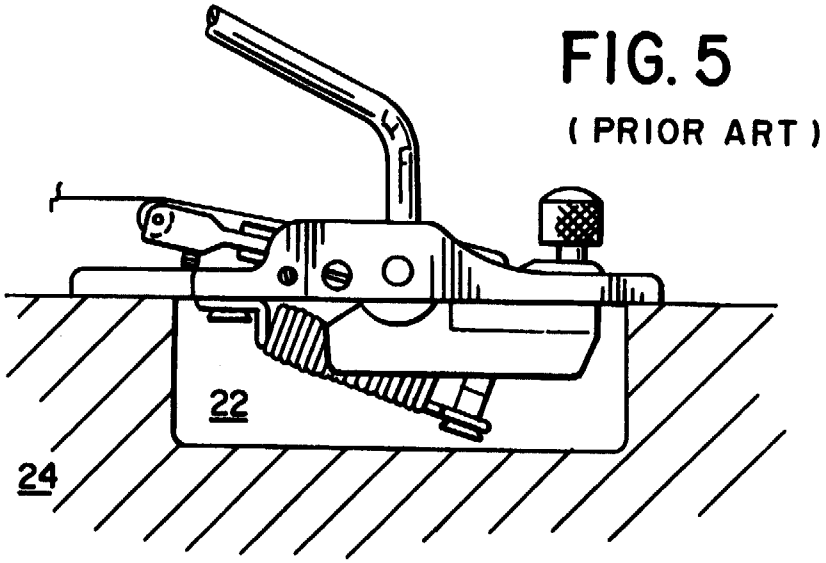
FIG. 5 (PRIOR ART)
FIG. 5 is an enlarged cross sectional side elevational view of a prior art tremolo mounted in an electric guitar with the tremolo level in a normal position.
Figure 4:
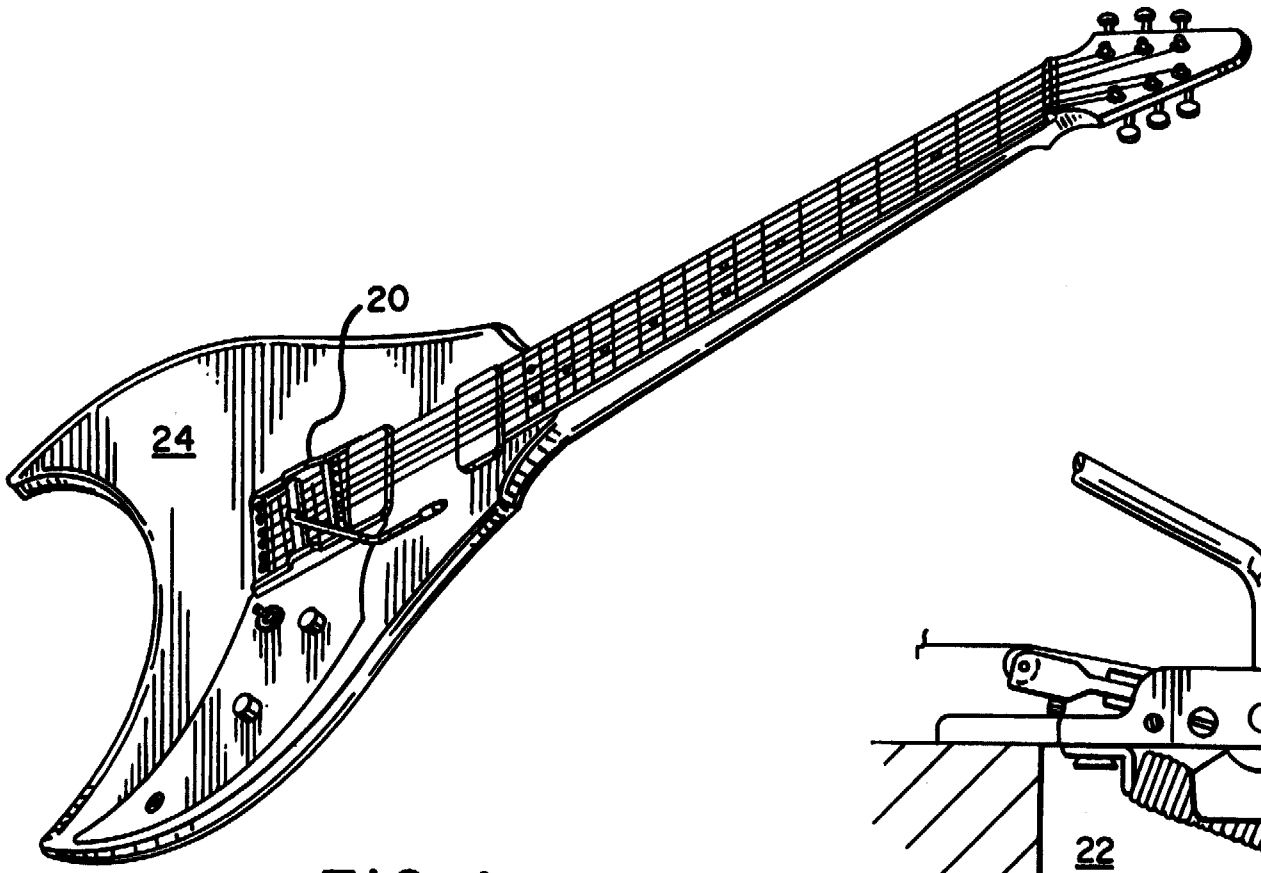
FIG. 4 is a perspective view of an electric guitar upon which either a prior art tremolo or the improved inventive tremolo can be mounted.
Figure 10:
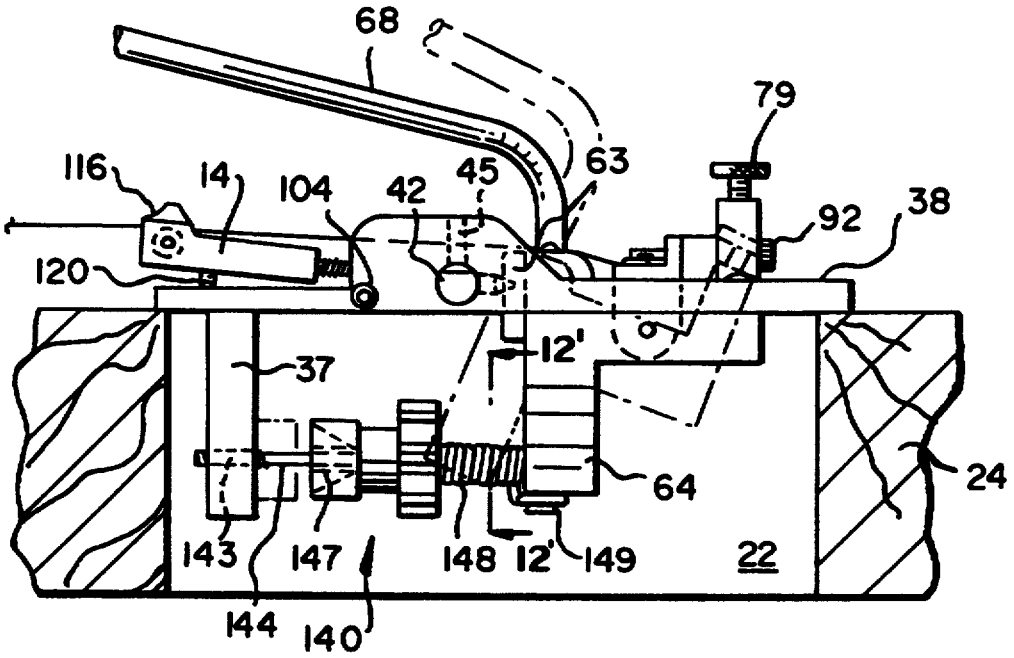
FIG. 10 is a side elevational view of the improved inventive tremolo mounted in an electric guitar with a phantom location of the tremolo shown when the tremolo lever is elevated increasing the pitch of the string.
Figure 9:
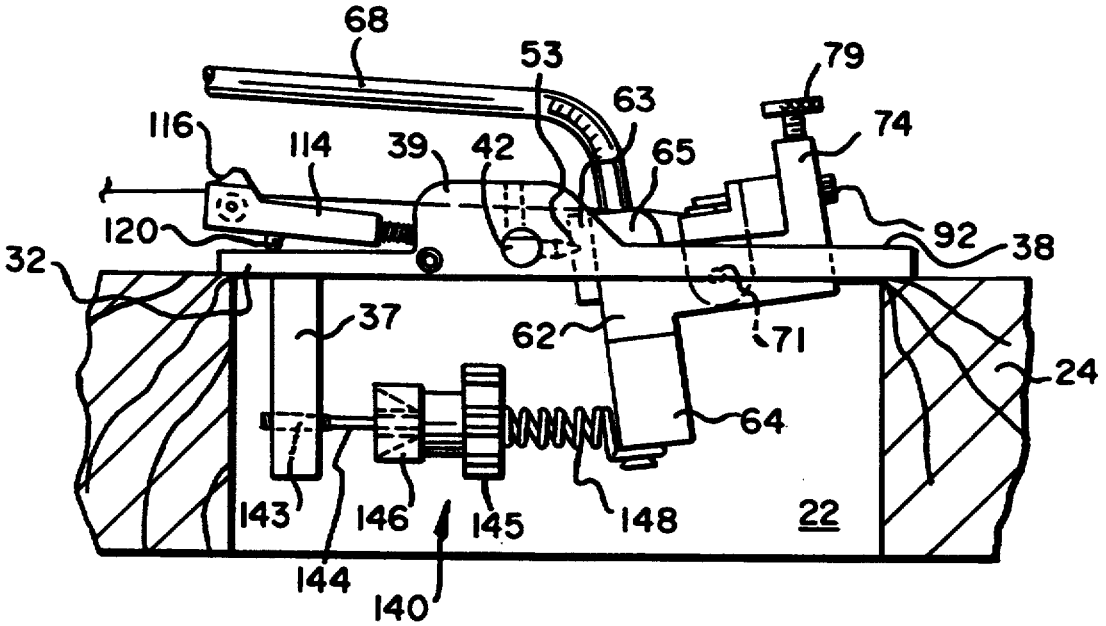
FIG. 9 is a side elevational view of the improved inventive tremolo mounted in an electric guitar shown when the tremolo lever, is depressed decreasing the pitch of the string.

The preferred embodiment and best mode of the invention is shown in FIGS. 4; 6 through 12 and 15 through 17. In accordance with the invention, the improved top mounting tremolo 20 is mounted into a well or cavity 22 of an electric guitar 24 as shown in FIGS. 4, 9 and 10. The tremolo 20 is a top mounting tremolo and is mounted in a cavity preferably cut ¼ inches deep in the top of the guitar. The top mounting construction of the tremolo eliminates thru-routing of the guitar or routing for the spring cavity which was required for prior art tremolos. Accordingly, there is no spring cavity plate necessary. The inventive tremolo mounts ¼ inch further back from the 12th fret than in any conventional tremolo, thus increasing space for pickups.

Figure 7:
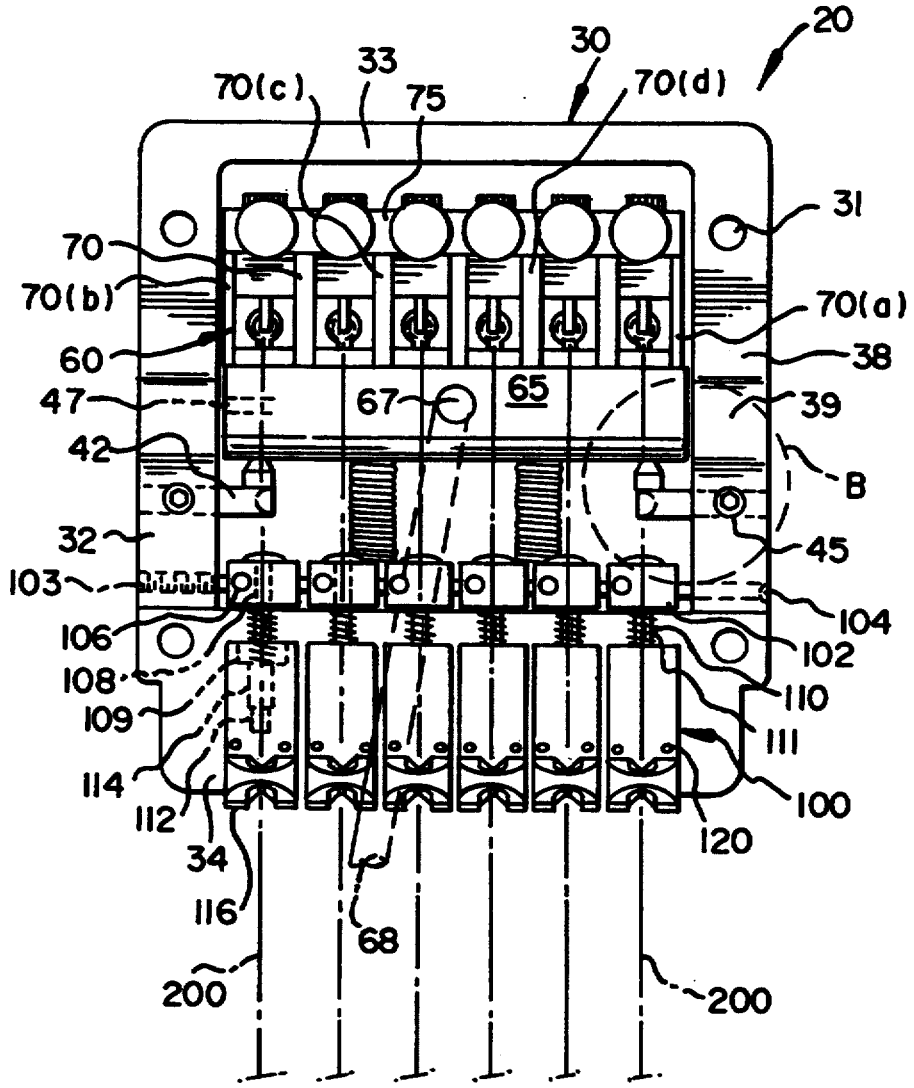
FIG. 7 is a top plan view of the improved inventive tremolo.
Figure 8:
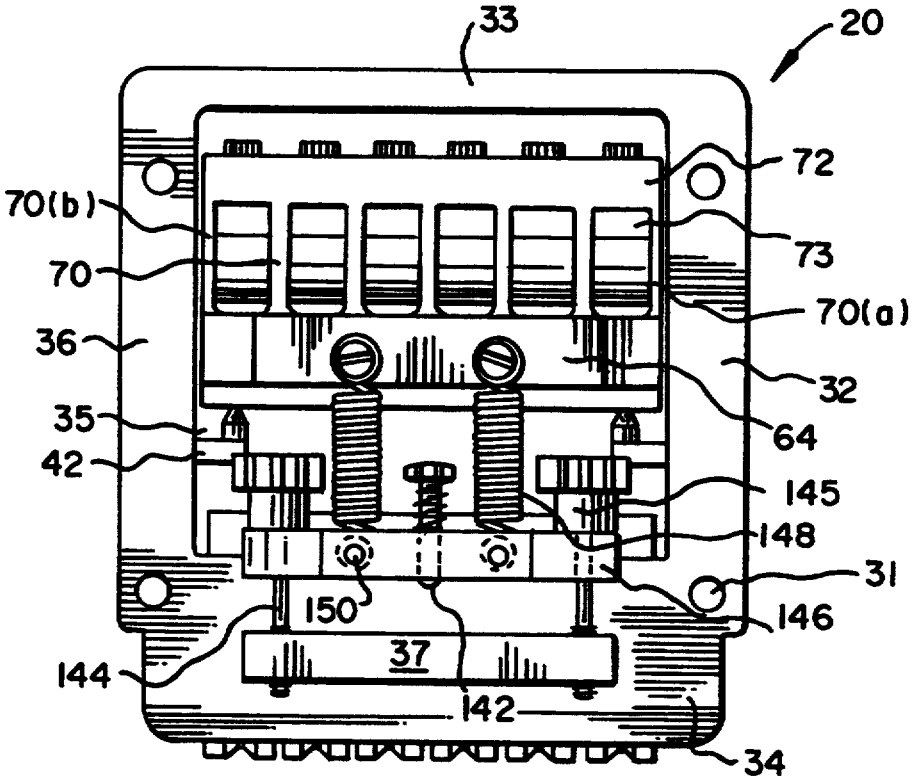
FIG. 8 is a bottom plan view of the improved inventive tremolo shown in FIG. 7.

The tremolo is constructed of a cast or milled stainless steel or brass metal base housing 30 with a generally rectangular shape formed by side sections 32, a distal end section 33 and a proximate end section 34 as shown in FIGS. 7–9. It should be understood that the housing and all parts of the tremolo can be made of any suitable metal or material. The integral sections form a rectilinear housing defining an interior chamber 35 or aperture and a planar base surface or bottom 36 which fits flush against the guitar surface. The housing 30 is provided with countersunk corner holes 31 allowing the housing 30 to be screwed onto the guitar 24 over cavity 22. Thus, the tremolo is self contained with no independent spring claw and screw. Mounted to the planar base on the proximate end 34 of the housing and extending away from the planar base is the housing integral spring biasing support block 37. The support block 37 is preferably formed integrally with the housing but can be mounted to the base housing 30 by screws. The upper surface 38 of the side members 32 are formed with raised portions forming yokes 39 which hold the mounting assembly 40. A carrier assembly 60 containing string mounting and tuning assemblies and string guide and saddle assemblies 100 are respectively mounted onto the housing 30 as will be later discussed.

Figure 16:
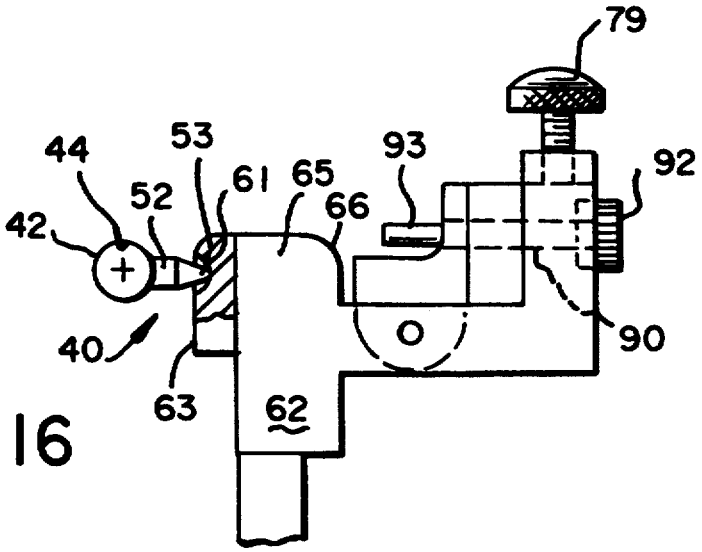
FIG. 16 is a side elevational view partially in cross section of the mounting assembly of the improved tremolo.

The double fulcrum mounting assembly 40 as more clearly shown in FIGS. 9, 10, 15 and 16 comprises two opposed cylindrical support posts 42 which are mounted in aligned bores 4 3 cut in the yokes 39 of opposing side portions of the housing. The posts 42 are removably mounted in the aligned bores 43 and may be optionally provided with an indention or aperture 44 which is adapted to receive a set screw 45. Each post 42 is provided with a mounting pin member 52 which extends outward from the axis of the post 90 degrees. The pin member 52 is provided with a conical sharp tip 53 which engages and is mounted in a larger diameter conical or circular cavity 61 cut into the mounting strip 63 secured to the carrier member 62. This construction is best shown in FIG. 16. Thus, a double fulcrum is provided which allows precision mounting with no slippage during use reducing friction to an absolute minimum producing an extremely clean sound.

Figure 17:
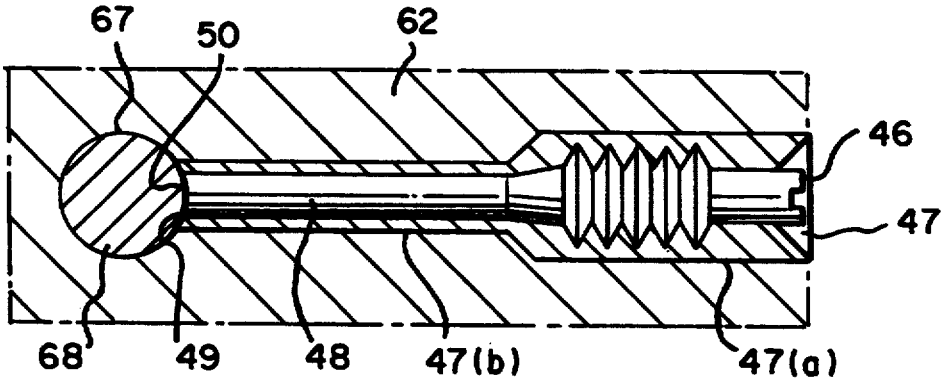
FIG. 17 is an enlarged schematic cross sectional view of the screw bore and tensioning screw and rod assembly for the tensioning the handle lever.

As seen in FIG. 17, a partially threaded tensioning bore 47 is cut through one end of the carrier member 62 to intersect the handle bore 67 of the lever handle 68. The tension bore 47 is cut with a larger threaded diameter section 47(*a*) and a smaller diameter smooth bore section 47(*b*), both of which are axially aligned. A set screw with an Allen head 46 is preferably constructed of a larger diameter threaded shank which is threaded into threaded bore section 47(*a*) to engage a rod 48 slidably housed in the smooth bore section 47(*b*). The rod 48 is cylindrical with a smooth outer surface and has a diameter smaller than bore section 47(*b*). The rod is provided with a distal end 49 which is cut in an arcuate fashion 50 to engage the rounded outer surface of the handle lever 68. As the set screw 46 is threaded into bore portion 47(*a*) it engages the proximal end of rod 48 driving the rod which is preferably teflon coated so that the arcuate end 50 engages and holds handle lever 68 in a tensioned position making it tight so it is stationary or loosely engaged so that handle lever 68 can swing freely depending on the desire of the player.

Figure 6A:
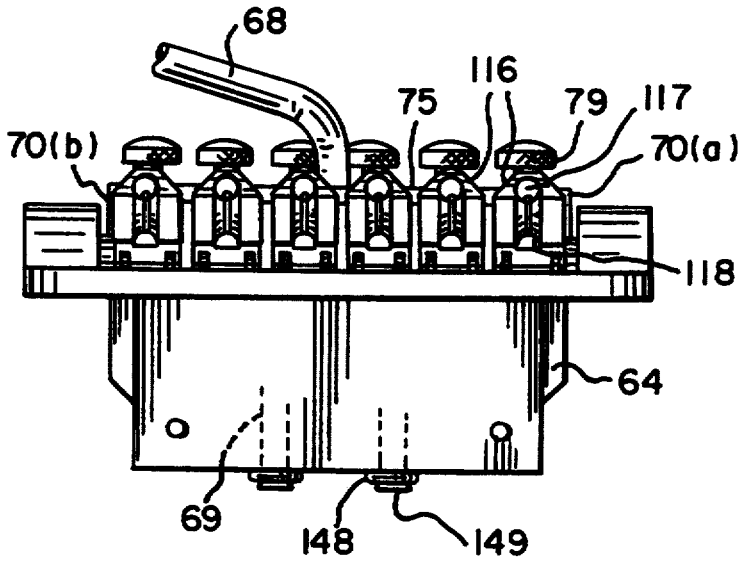
FIG. 6(*a*) is an enlarged front elevational view of the inventive tremolo removed from an electric guitar.
Figure 6B:
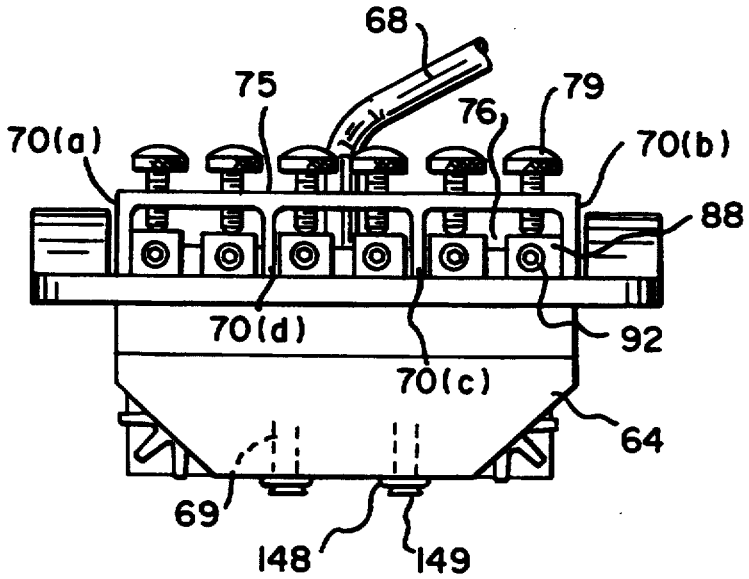
Figure 11:
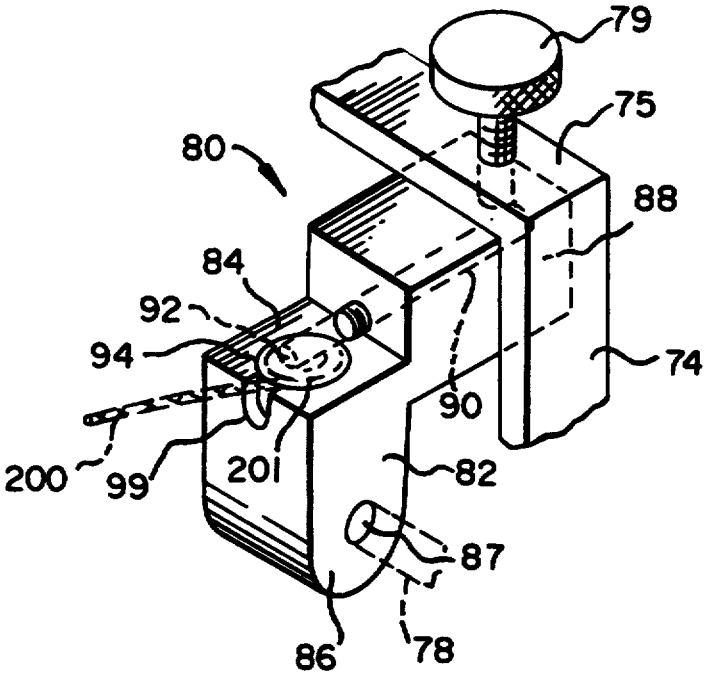
FIG. 11 is an enlarged isolated perspective view of a string attachment member of the inventive tremolo with a guitar string mounted therein.

In the string mount and carrier assembly 60, the carrier housing 62 has a substantially "Z" shaped side elevational configuration, one end of the housing forming a carrier section 65 with a curved upper surface 66. The upper curved surface 66 is provided with one or more blind bores 67 adapted to receive the threaded end of a handle lever 68 therein in one or more selected positions. Preferably, one of the blind bores 67 is positioned in the middle of carrier section 65 equalizing the force on the fulcrum points when in use. This mid point position also allows handle lever 68 to be lifted and depressed without torquing the handle lever arm to one side or the other. A trapezoidal shaped spring mounting block 64 as seen in FIG. 6(*b*) is secured to the carrier section 65 or is preferably integral thereto opposite the upper curved surface 66 and extends downward into the cavity 22 of the guitar 24. A pair of spaced threaded blind bores 69 are cut up into the spring mounting block 64 to receive screws 149 thereby holding springs 148 fixedly attached thereto. A mounting strip 63 which defines conical cavities 61 for the fulcrum points is secured to the carrier section 62. A plurality of parallel spaced key seat strip members 70 as best seen in FIG. 7 are integrally formed with the carrier housing 62 and extend perpendicularly away from it terminating in an integral end cross member 72 to form a sectioned housing defining a plurality of key chambers 73. Outside strip members 70(*a*) and 70(*b*) and inside strip members 70(*c*) and 70(*d*) are provided with upright support sections 74 which extend upward from the end cross member 72 at a 90 degree angle from the longitudinal axis of the strip members to form upright supports. An integral flat linear cross member 75 intersects the upper ends of the upright supports 74 forming a bracket assembly 76. Each of the strip members 70 is provided with a centrally located throughgoing bore 71, the bore being axially aligned to receive a rod 78 which supports string mount key assemblies 80 as shown in FIG. 11.

Figure 13:
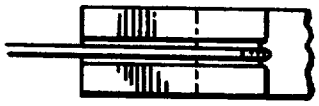
FIG. 13 ( PRIOR ART )
FIG. 13 is a top plan view of a guitar string partially shown in phantom mounted in the string attachment member of a prior art tremolo.
Figure 14:
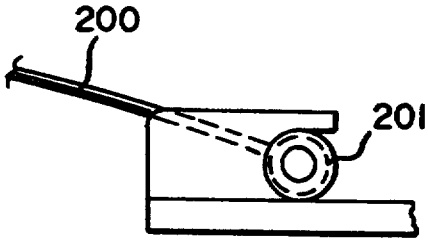
FIG. 14 ( PRIOR ART )
FIG. 14 is a side elevational view of a guitar string partially shown in phantom mounted in the string attachment member of the prior art tremolo of FIG. 13.
Figure 15:
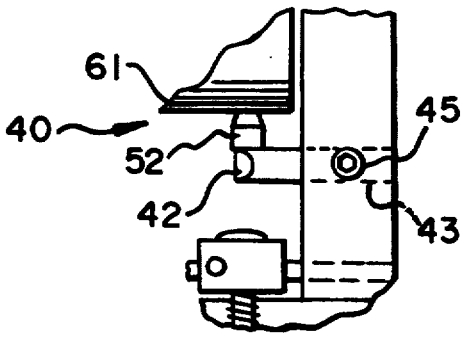
FIG. 15 is an enlarged top plan view of the mounting assembly generally illustrated by the circled area B of FIG. 7.

Each string mount key assembly 80 is constructed with a "P" shaped base member 82 defining a stepped cutout section 84 located between a rounded end portion 86 and a rectangular end portion 88. The rounded end portion 86 is provided with a throughgoing bore 87 to receive rod 78 which has been passed through the bores 71 of strip members 70. The base member 82 is moveably positioned with respect to cross member 75 by fine tuning screws 79 equidistantly spaced and threadably mounted in the cross member 75. Each tuning screw 79 can fine tune its respective string two full steps and the screw is turned clockwise to increase the pitch of the string. The force of the string continuously forces end portion 88 upwards towards the cross member 75. The rectangular end portion 88 of each string key assembly 80 in addition to receiving the thread tuning screw 79 is also provided with a string locking bore 90 which leads into the stepped cutout section 84 above an instrument string eyelet basin 94. The bore 90 receives a threaded adjustment thumbscrew 92. The stepped cutout section 84 defines the instrument string eyelet basin 94, which is of sufficient diameter and depth to receive the eyelet end 201 of a guitar string 200 or other musical instrument string such as that shown in FIG. 14, and further defines a "U" shaped channel 99 which leads from the rounded end portion 86 to the eyelet basin 94 to provide entry to and exit from the cutout basin 94 for instrument string 200. The channel 99 is of sufficient width to easily accommodate a guitar or other musical instrument string. Thumb screw 92 is threaded in bore 90 so that its distal end projects outward over the string eyelet 201 thereby holding it firmly locked in place as shown in FIG. 11. Thus, the string eyelet 201 is mounted vertically opposite to that shown in FIG. 13 and 14 so even tension is applied on both sides of the string wind.

The string guide saddle assembly 100 comprises a plurality of spaced support blocks 102, one for each of the instrument strings. Each of the support blocks 102 is mounted on a rod 104 mounted in the side wall sections 32 of the base housing 30. The support blocks 102 define a throughgoing bore 103 through which rod 104 runs through and each of the support blocks 102 are held in place on the rod 104 by means of set screws 106 which are mounted in threaded bores cut through the support blocks leading to the rod bore 103. It should be noted that screw bores for set screws 106 are off set from the string position to allow easy access. Each support block 102 is also provided with a longitudinally placed threaded adjustment bore 108 positioned perpendicular to the axis of the rod bore 103 and located above the rod bore 103. Each adjustment bore 108 receives an adjustment screw 110 which extends into a threaded blind bore 112 of a string guide saddle 114 so that the screw when rotated can move the string guide saddle 114 toward or away from the fixed support block 102. The forward and backward movement allows for setting of intonation at respective octaves. Thus, the player can make the string frequency the same at octave as at open string. A spring 111 is mounted around the shaft of adjustment screw 110 and is seated in spring support seat 109 cut along bore 112 in the string guide saddle 114. This spring pressure allows the string guide saddle 114 to move forward to overcome the tension of the instrument string 200 exerted vertically and the friction of the adjustment elevation screw 120. This adjustment screw is preferably a #4–40 set screw ¼ inch long but can be any suitable length depending on user preference. It should be noted that these screws are offset from the instrument string paths to allow easy adjustment without interference with the string. This adjustment allows height of the string from the fret board of the guitar or stringed instrument to be set to the preference height of the individual player. The difference in height does not change intonation which is a function of the forward and backward positioning of the string guide saddle 114. The proximate end of the string guide saddle 114 is notched and provided with an eyelet member 116 having a circle shaped opening 117 and rotatable "V" grooved roller 118 which is removably mounted to the eyelet member 116 by an axle (not shown). If desired, the eyelet member can be provided with an integral "U" shaped groove in place of the roller 118 which would also eliminate the axle. The string guide saddle 114 is also provided with threaded elevational bores 119 which hold adjustment elevation screws 120. The adjustment elevation screws 120 can be threaded so that the distal end of the screw engages the upper surface of end 34 of the housing 30.

Figure 12:
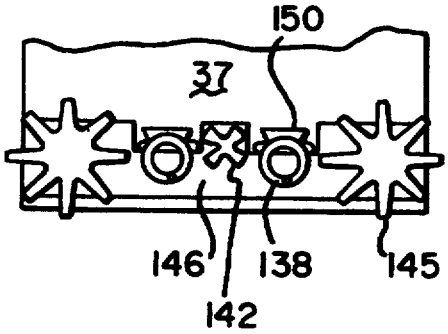
FIG. 12 is a partial rear elevational view of the improved inventive tremolo taken along line 12'—12' of FIG. 10.

A spring biasing assembly 140 is mounted to the underside of the tremolo housing on the spring biasing block 37. Two spaced support rods 144 are mounted in threaded bores 143 cut through the spring biasing block or support member 37 and extend away from the support member 37 parallel to each other. In between the threaded bores 143 on cross member 146 is a threaded bore which receives a limit screw 142 which can be threaded through support cross member 146 any sufficient distance to provide a stop against support member 37 which limits backpull. The spring support cross member 146 is slidably mounted on the support rods 144 as the rods extend through throughgoing bores 147 in the cross member 146, which bores have a diameter which is larger than the diameter of the support rods 144. The support rods 144 are threaded on one end to engage support member 37 and have mounted on the other end a handle and collar mechanism 145 which when rotated drives the support cross member 146 along rods 144 causing the coil springs 148 to bias the assembly pulling it downward. The two spaced coil springs 148 are mounted to the cross member 146 by set screws 150 as shown in FIG. 12 holding the coil springs 148 firmly in place. The other end of the coil springs 148 are mounted to the trapezoidal shaped spring mounting block 64 by screws 149 or other appropriate fastening means as shown in FIGS. 9 and 10.

In operation when the instrument is being strung the eyelet end 201 of the instrument string 200 is placed in the cutout basin 94 with the string extending from the cutout basin 94 through channel 99. The eyelet end 201 of the string 200 seated in the cutout basin 94 is locked or held in place in the cutout basin 94 by adjustment thumbscrew 92. The string is then run over carrier surface 65 through the string guide saddle 114 and the circle shaped opening 117 of the eyelet guide 116 and then tightened in the tuning lock of the guitar. The string guide saddles 114 can be linearly and vertically positioned by turning respective screws to accomplish intonation and positioning of the instrument string. Fine tuning can be accomplished by rotating the fine tuning screw 79. During play, rotation of the string mount and carrier assembly 60 by the lever 68 will produce a vibrato effect owing to a change in tension on the instrument strings. When the handle lever is elevated, the pitch of the strings will be increased and when the handle lever is depressed, the pitch of the strings will be decreased. Due to the unique mounting assembly 40 the instrument will remain in tune each time handle lever 68 is utilized to produce the vibrato effect.

Furthermore, the string guide saddle keeps the string in place on the roller unlike other prior art tremolos which, when the lever is depressed, the string occasionally pops out of the string guide roller.

In the foregoing description, the invention has been described with reference to a particular preferred embodiment, although it is to be understood that specific details shown are merely illustrative, and the invention may be carried out in other ways without departing from the true spirit and scope of the following claims:

I claim:

1. A string mounting and tuning device for a stringed musical instrument, comprising;

(a) a housing;

(b) an instrument string carrier assembly mounted to said housing by a point and cone mounting means, said string carrier assembly including a cross member, individual string mounting keys members removably mounted to said cross member, each string mounting key member defining a basin of sufficient depth and width to receive the eyelet end of an instrument string and defining a channel leading to said basin to hold said instrument string;

(c) string guide saddle means mounted to said housing, said string guide saddle means comprising a fixed support member and a linearly and angularly adjustable string guide member moveably connected to said fixed support member; and (d) spring means connected to said string carrier to bias said string carrier assembly with respect to said housing.

2. A device as claimed in claim 1 wherein said point and cone mounting means comprises a rod with a pointed end extending from said housing, the pointed end of said rod engaging a curved cavity formed in said string carrier assembly.

3. A device as claimed in claim 1 wherein said string carrier assembly comprises a mounting member, a plurality of spaced parallel integral strip members extending from said mounting member to an end cross member forming a plurality of parallel key chambers, a plurality of upright support members extending away from said end cross member, and said cross member engaging and interconnecting said plurality of upright support members.

4. A device as claimed in claim 3 further comprising a plurality of key members mounted to said cross member mounted on said uprights, each said key member being provided with a cutout section near its midpoint, said cutout section defining a string eyelet receptacle and a string channel leading to said string eyelet receptacle.

5. A device as claimed in claim 4 further including locking means mounted in each of said key members to hold said string eyelet in said string eyelet receptacle.

6. A device as claimed in claim 1 wherein string guide saddle means comprises a plurality of fixed base blocks connected to said housing, each base block being provided with screw means extending through said base block into a threaded blind bore of a string guide saddle, said screw means being adapted to move said string guide saddle linearly with respect to said respective base block and adjustment screw means in said string guide saddle to angularly adjust the axis of said string guide saddle with respect to said housing surface.

7. A device as claimed in claim 6 wherein said screw means comprises a screw and spring means surrounding said screw, said spring means being seated in a spring seat formed in said string guide saddle.

8. A device as claimed in claim 1 wherein said spring means comprises a support member secured to said housing, rod means mounted to said support member and extending from said support member, a spring mount member slidably mounted on said rod means, a spring means mounted to said spring mount member and handle means mounted on said rod means to engage said spring mount member and traverse said spring mount member along said rod means.

9. A device as claimed in claim 8 wherein said rod means comprises two parallel rods threaded on one end, the other end receiving a handle means comprising a handle and collar assembly so that turning of said handle means causes said handle assembly to be reciprocated with respect to said housing.

10. A device as claimed in claim 1 wherein said string saddle means comprises a plurality of guide members connected to said housing, each guide member comprising a linear adjustment member defining a threaded bore for receiving a screw to angularly adjust the axis of said linear adjustment member with respect to said housing surface and a threaded blind bore for receiving a screw carrying a stationary support, said stationary support member defining a throughgoing bore which is positioned with an axis perpendicular to the screw axis, and roller means moveable mounted to the end of said linear adjustment member.

11. A device as claimed in claim 1 wherein instrument string saddle means comprises a plurality of guide members connected to said housing, each guide member comprising a linear adjustment member defining a threaded bore for receiving a screw to angularly adjust the axis of said linear adjustment member with respect to said housing surface and a threaded blind bore for receiving a screw mounted through a stationary support member, said stationary support member defining a throughgoing bore which is positioned with an axis perpendicular to the screw axis, and integral string eyelet means formed on one end of said linear adjustment member.

12. A device as claimed in claim 1 wherein said string carrier assembly comprises a plurality of strips extending from and integral to a mounting bar, said strips engaging an end cross member forming a plurality of parallel key chambers, with said cross member being connected to said end cross member by uprights.

13. A device as claimed in claim 12 further including a spring mounting support member secured to said integral mounting bar and extending away from said integral mounting bar.

14. A device as claimed in claim 12 wherein said cross member defines a plurality of spaced throughgoing threaded apertures to receive a plurality of tuning thumb screws, said tuning screws being adapted to engage and angularly position string key members for fine tuning.

15. A device as claimed in claim 12 further including a support member with a curved upper surface mounted to said mounting bar, said support member defining cavity means to receive the point and cone mounting means.

16. A tremolo for a stringed musical instrument, comprising;

(a) a housing defining a central aperture with integral side portions and end portions, said side portions being formed with a raised upper surface forming a yoke;

(b) mounting means mounting an instrument string holding means to said housing, said mounting means comprising a plurality of opposing posts extending from said housing into said central aperture, a point member mounted to each said post, said point member comprising a cylindrical portion and a conical portion terminating in a end point, the end point of said point member engaging a cavity means formed in said instrument string holding means;

(c) said instrument string holding means comprising a carriage with a base member, a plurality of integral strips extending from said base member to an end cross member forming a plurality of parallel key chambers, upright members extending from said end cross member, and a second cross member secured to and interconnecting said upright members, individual string mounting blocks removably mounted to said integral strips, each string mounting block defining a cutout section of sufficient depth and width to receive the end of an instrument string and a channel leading to said cutout section of a width greater than the width of said instrument string to receive an instrument string;

(d) string guide means mounted to said housing, said string guide means comprising a linearly and angularly adjustable string guide assembly, each guide assembly comprising a fixed member and a linear adjustment member movably connected to said fixed member, said linear adjustment member defining a throughgoing threaded bore for receiving a screw to angularly adjust the axis of said linear adjustment member with respect to said housing surface and a threaded blind bore for receiving a connector screw carried by said fixed member, said connector screw being adapted to move said linear adjustment member toward and away from said fixed member, and string eyelet means secured to linear adjustment member, and (e) spring means to bias said string mounting means with respect to said housing.

17. A device as claimed in claim 16 wherein said yoke is provided with inwardly projecting posts with perpendicular projecting pointed pivot arms engaging said instrument string holding means.

18. A tremolo for a stringed musical instrument, comprising;

(a) a housing defining a central aperture;

(b) an instrument string holding means including a carriage, mounting means mounting said carriage to said housing, said mounting means comprising a double fulcrum means;

(c) said carriage including a housing, a bracket assembly extending from said housing, a plurality of string mounting keys moveably mounted to said bracket assembly, each string mounting key receiving the end of an instrument string and holding the end of the string in a locked position;

(d) string guide means mounted to said housing, said string guide means comprising a plurality of linearly and angularly adjustable string guides; and (e) spring means to bias said carriage with respect to said housing.

19. A tremolo for a stringed musical instrument as claimed in claim 18 wherein said double fulcrum means comprises a plurality of opposing posts extending from said housing into said central aperture, a point member mounted to the distal end of each said post, said point member comprising a cylindrical portion and a conical portion terminating in a point, the point end of said point member engaging cavity means formed in said carriage housing.

20. A tremolo for a stringed musical instrument as claimed in claim 19 wherein said means is a cone shaped depression.

21. A tremolo as claimed in claim 18 including lever means mounted to said carriage support bar for manually rotating the lever means relative to said housing during sounding of the instrument to produce a vibrato effect.

22. A tremolo as claimed in claim 21 wherein said carriage support bar defines a throughgoing bore means which intersects a bore holding said lever means, said throughgoing bore means being provided with tensioning means.

23. A tremolo as claimed in claim 18 wherein string guide means comprises a plurality of stationary support members mounted to said housing, a respective guide member assembly connected to one of said stationary support members, each guide member assembly comprising a linear adjustment member defining a threaded bore for receiving a screw to angularly adjust the axis of said linear adjustment member with respect to said housing surface and a threaded blind bore for receiving a screw mounted through a stationary support member to axially move said linear adjustment member providing intonation for the string guided by said guide member assembly, and string eyelet means formed on one end of said linear adjustment member.

24. A tremolo as claimed in claim 23 wherein said eyelet means includes roller means mounted thereto to allow an instrument string to move along the roller means surface.

25. A tremolo as claimed in claim 23 wherein said eyelet means includes an integral grooved surface to allow an instrument string to move along the grooved surface.

26. A tremolo for a stringed musical instrument, comprising;

(a) a housing defining a central aperture;

(b) an instrument string holding means including a carriage assembly moveably mounted to said housing in said central aperture;

(c) mounting means mounting said instrument string holding means to said housing, said mounting means comprising a plurality of opposing posts with point means positioned against and engaging cavity means;

(d) said carriage assembly including a base member and side members extending from said base member, individual string mount assemblies are removably mounted to said side members, each string mount assembly defining a basin of sufficient depth and width to receive the end of an instrument string and a channel leading to said basin of a width greater than the width of an instrument spring and lock means on each mount assembly to hold said instrument string ends in said basin;

(e) string guide saddle means mounted to said housing, said string guide saddle means comprising a linearly and angularly adjustable string guide mechanism; and (f) spring means to bias said string holding means with respect to said housing against the force of instrument strings.

27. A tremolo for a stringed musical instrument as claimed in claim 26 wherein said opposing posts are mounted to said housing and extend from said housing into said central aperture, a point member is mounted to the distal end of each said post, said point member comprising a cylindrical portion and a conical portion terminating in a point, the point of said point member engaging a curved cavity formed in said string carriage member.

28. A floating one piece tremolo for a stringed instrument allowing adjustment of the instrument and keeping the instrument in tune comprising a housing, a carriage moveably mounted in the housing by a floating pivot point means held together by the action of instrument strings and tremolo springs opposing each other, the carriage being spring biased and provided with string holding keys, each string holding key having locking means to keep an eyelet of the instrument string in place, and a string saddle guide assembly mounted to the housing, said string saddle assembly being vertically and linearly positioned by screw means.

* * * * *